US006399263B1

(12) United States Patent
Hayata

(10) Patent No.: US 6,399,263 B1
(45) Date of Patent: Jun. 4, 2002

(54) ELECTROPHOTOGRAPHIC PHOTORECEPTOR, ELECTROPHOTOGRAPHIC PROCESS, AND ELECTROPHOTOGRAPHIC IMAGE FORMING METHOD

(75) Inventor: Hirofumi Hayata, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/564,483

(22) Filed: May 4, 2000

(30) Foreign Application Priority Data

May 10, 1999 (JP) ..... 11-128890

(51) Int. Cl.[7] ..... G03G 5/14; G03G 5/10

(52) U.S. Cl. ..... 430/63; 430/65; 430/69; 430/131

(58) Field of Search ..... 430/63, 64, 65, 430/69, 59.5, 131

(56) References Cited

U.S. PATENT DOCUMENTS 5,372,904 A * 12/1994 Yu et al. ..... 430/64
5,612,158 A * 3/1997 Iguchi et al. ..... 430/65
5,753,395 A * 5/1998 Kinoshita et al. ..... 430/59.5
6,150,063 A * 11/2000 Sugimura et al. ..... 430/59.5

FOREIGN PATENT DOCUMENTS

| | | |
|---|---|---|
| JP | 63231147 | 9/1988 |
| JP | 63234261 | 9/1988 |
| JP | 1069116 | 3/1998 |
| JP | 10186703 | 7/1998 |

* cited by examiner

*Primary Examiner*—Christopher Rodee
(74) *Attorney, Agent, or Firm*—Bierman, Muserlian and Lucas

(57) ABSTRACT

An electrophotographic photoreceptor having an interlayer between the electrically conductive base body and the photosensitive layer. The electrophotographic photoreceptor an aluminum-evaporated surface and contact potential difference of said interlayer with respect to the aluminum-evaporated surface of the photoreceptor is at least +0.175 V.

7 Claims, No Drawings

ELECTROPHOTOGRAPHIC PHOTORECEPTOR, ELECTROPHOTOGRAPHIC PROCESS, AND ELECTROPHOTOGRAPHIC IMAGE FORMING METHOD

FIELD OF THE INVENTION

The present invention relates to an electrophotographic photoreceptor having an interlayer, and further to an electrophotographic process and an electrophotographic image forming method in which an electrostatic latent image is formed employing said photoreceptor, and subsequently image formation is carried out employing reversal development.

BACKGROUND OF THE INVENTION

In the transition of electrophotographic receptors, a leading part has been changing from inorganic photoreceptors comprised of arsenic, arsenic/Se alloy, CdS, ZnO, and the like, to organic photoreceptors which are superior to the inorganic photoreceptors with respect to environmental protection, ease of production, and the like. Organic photoreceptors employing various materials have been developed.

In recent years, separate function type photoreceptors, in which a charge generating function and a charge transport function are achieved employing different materials, have played a leading role. Of these, multilayered type photoreceptors are widely employed in which the layer consists of a charge generating layer and a charge transport layer.

When attention is directed to the electrophotographic process, latent image forming methods are mainly divided into analogue image formation employing a halogen lamp as the light source and digital image formation employing LED and laser as the light source. Recently, a latent image forming method employing a digital system has increasingly been employed in hardcopy printers for personal computers as well as common copiers due to ease of image processing as well as ease of expansion to peripheral apparatuses.

As described above, in the image formation employing the digital system, when an electrostatic latent image is formed on a photoreceptor employing image information which is converted to digital electrical signals, employed as light sources are lasers, especially semiconductor laser, and LED. These emit light having a relatively long wavelength and most emit light having a wavelength of at least 650 nm. Charge generating materials, which exhibit viable sensitivity to these light sources, include phthalocyanines, bisimidazoleperylene, squalirium, and the like. Of these, phthalocyanines are most widely employed due to their various crystal forms as well as their general usefulness as pigments.

On the other hand, said phthalocyanines exhibit relatively large variations of the performance due to ambient differences in temperature, humidity, and the like. As a result, required are mechanical controls such as variation of the intensity of exposure light, charged electric current, and the like matching to the ambience, in which said phthalocyanines are employed.

On the other hand, when a latent image is formed employing a laser beam, a peculiar image problem is known in which interference fringes are formed due to reflection from the base body surface. The digital system is mainly employed in combination with reversal development in which an exposed part is developed. Known as peculiar problems of said system are phenomenon in which toner adheres on white background due to a decrease in the electrostatic potential, forming background stain, the formation of white spots and also black spots due to local defects on the photoreceptor.

In order to solve these problems, techniques, in which an interlayer is provided, have been developed. Japanese Patent Publication Open to Public Inspection Nos. 63-231147, 63-234261, and others, disclose similar compositions to minimize interference fringes, or moire, which are formed during writing employing laser beams, upon utilizing irregular reflection due to the refractive index of the white pigment. Further, Japanese Patent Publication Open to Public Inspection No. 10-186703 discloses a countermeasure to minimize differences in the charged amount and the like, between the first rotation and the second rotation of the photoreceptor, which occurs when said phthalocyanine is employed as the charge generating material. Still further, Japanese Patent Publication Open to Public Inspection No. 10-69116 discloses a countermeasure to minimize image defects (such as background stain and minute black spots) as well as a method to minimize variations of the residual potential due to ambient conditions.

Some of these inventions provide methods to overcome any of individual problems. However, when the thickness of an interlayer is increased, with the main aim to overcome the moire problem, the residual potential increases. On the other hand, when minimization of variations of residual potential as well as sensitivity due to ambient conditions is the main goal, only a relatively thin interlayer needs to be provided. Thus, conventional countermeasures have not been capable of producing high quality, nor of providing the optimum charge potential properties, which are required for the photoreceptor.

SUMMARY OF THE INVENTION

In view of the aforementioned conventional technical problems, it is an object of the present invention to provide a photoreceptor which satisfies any of the stated characteristics and is capable of providing electrophotographic images without variation, and an electrophotographic process as well as an electrophotographic image forming method employing-the same.

Specifically, it is an object of the present invention to solve the following problems:

1) To minimize variations of the sensitivity of the photoreceptor due to ambient conditions
2) To minimize differences in the charge amount between the first rotation and the second rotation of said photoreceptor
3) To prevent degradation of chargeability due to ambient conditions as well as repeated use.

(wherein the first rotation means a first rotation of the photoreceptor after an instruction for forming image; and the second rotation means following rotation to the first rotation.)

An outline of the present invention will now be described.

In an electrophotographic photoreceptor comprising an interlayer between the electrically conductive base body and the photosensitive layer, an electrophotographic photoreceptor wherein a contact potential difference of said interlayer with respect to an aluminum-evaporated surface is at least +0.175 V.

Said electrophotographic photoreceptor preferably comprises an interlayer comprised of fine titanium oxide particles and a resin, between the electrically conductive base body and the photosensitive layer.

Said contact potential difference is preferably at least +0.200 V.

When the thickness of said interlayer is set at 5 $\mu$m, the transmittance for light of 780 nm is preferably at least 10 percent.

The thickness of said interlayer is preferably at least 5 $\mu$m.

The charge generating material is preferably phthalocyanine.

The charge generating material, which is contained in a photosensitive layer, is preferably titanyl phthalocyanine having a maximum diffraction peak in the X-ray diffraction spectrum (having a Brag angle 2θ±0.2 degree) of a CuK α-ray at 27.2 degrees.

The charge generating material, which is contained in a photosensitive layer, is titanyl phthalocyanine having a maximum diffraction peak in the X-ray diffraction spectrum (having a Brag angle 2θ±0.2 degree) of a CuK α-ray at 27.2 degrees and peaks at 9.5 degrees as well as 24.1 degrees.

An electrophotographic photoreceptor is preferably employed to form an image employing a reversal development method.

An electrophotographic photoreceptor, after forming an electrostatic latent image on itelf employing a digital system, is preferably employed for an electrophotographic image forming method for image formation.

DETAILED DESCRIPTION OF THE INVENTION

By these inventions, it is possible to achieve following effects from (1) to (4).

(1) Variation of sensitivity is extremely small under various employed ambient conditions from high temperature and high humidity to low temperature and low humidity.

(2) Difference in the charged amount between the first rotation and the second rotation of the photoreceptor is very small.

(3) Variation of chargeability during repeated use under various ambient conditions is extremely small.

(4) The aforementioned effects are not so dependent on the thickness of the interlayer.

When phthalocyanines, especially Y-type phthalocyanines (such as phthalocyanines having a maximum peak in the X-ray diffraction spectrum (having a Brag angle of 2θ±0.2 degree) of a CUK α-ray at 27.2 degrees) are employed as charge generating materials, variation of sensitivity due to ambient conditions has been pointed out as a big problem. However, according to the present invention, variation of sensitivity due to ambient conditions is minimized to such a level that said variation is barely noticed. Further, the stability of charged properties is enhanced. Due to that, the difference in the charge amount between the first rotation and the second rotation of the photoreceptor, which is subjected to exhaustion, is markedly minimized, compared to a photoreceptor comprising the conventional interlayer. Since electrical potential performance is not degraded due to the variation of interlayer thickness, it has become possible to minimize moire which, is a problem especially for laser exposure. It is especially mentioned that in order to minimize said moire due to laser exposure, when the thickness of the interlayer is increased to at least 10 $\mu$m, and to an extreme at least 10 $\mu$m, improvement of electrical potential properties exhibits high effects.

As a means to solve problems of images as well as the electrical potential, the present inventors paid close attention to the phenomenon caused the during charge injection process in a photoreceptor having an interlayer, especially the inventor has found that a contact potential difference of the interlayer with respect to an electrical base member affected to solve aforementioned problems. Further it was discovered that when the contact potential difference of the interlayer with respect to the aluminum-evaporated surface is at least +0.175 V, particularly at least +0.2 V, it is possible to provide an excellent photoreceptor which minimizes variation of sensitivity due to ambient conditions and exhibits a consistent difference in charged amount between the first rotation and the second rotation of said photoreceptor.

This is supported as follows. The charge injection process is affected by workfunctions of the base member of the photoreceptor and interlayer. However in the photoreceptor, it is difficult to specify the workfunction of the base member (electrical base member), because the workfunction of the base member is easily changed by a process (washing etc.) for a surface of the base member. The workfunction is influenced by a very small quantity of material attached on the surface of the base member. Therefore even if the photosensitive layer or the interlayer are removed from the photoreceptor, the surface of the remained base member does not provide a correct workfunction.

However it is possible to measure a workfunction corresponding to the surface which was processed by spattering the base member with a electric material. (No layer is provided on the spattered surface.)

On the other hand, the workfunction of the interlayer are constant and are not influenced by the process for the interlayer. For example, after we provided a photosensitive layer on the interlayer, we removed the photosensitive layer by solution. We found that the result of measurements of workfunction before and after these procedure were substantially constant.

Wherein it is possible to specify the workfunction of each surface by a potential of the surface. Inventors paid attention to a difference (contact potential difference) between the potential of the surface of the electric base member and the potential of the surface of the interlayer as an indicator of statement of the charge injection Process. (A specification of the measurement for the contact potential difference are shown hereinafter.)

In the present invention, as a means to measure contact equilibrium, a contact potential difference measurement was employed. In the contact potential difference measurement, the potential difference generated during contact with a specified metal (commonly, gold is employed) is measured and the work function of said measured material is determined.

A method, generally called the Kelvin method, is employed for said measurement. The Kelvin method, as well as the method to determine the work function, is described in detail in "Shinjikkenkagaku Koza 18—Hyomen to Koroido (Lectures on New Experimental Chemistry—Surface and Colloid)" (edited by Nihon Kagakukai) pages 181 to 192.

A method to determine the contact potential difference of the interlayer and an aluminum-evaporated surface is described below.

First, employing a gold electrode as the counter electrode, a potential difference generated on the aluminum-evaporated surface and the metal electrode surface is measured. A measured value is denoted as (Au–Al)V.

Next, an approximately 5 μm thick interlayer is formed on the aluminum-evaporated surface. Employing a gold electrode as the counter electrode, the potential difference generated on the interlayer surface and the gold electrode surface is measured. The measured value does not depend on thickness of the interlayer. The obtained measurement value is designated as E(Au–Interlayer)V. The contact potential difference (Al–Interlayer) of the interlayer and the aluminum-evaporated surface is determined by the formula (1) described below.

$$E(\text{Al–Interlayer})V = E(\text{Au–Interlayer})V - E(\text{Au–Al})V \qquad \text{Formula (1)}$$

The relationship between the interlayer and the aluminum electrode, which is obtained utilizing such contact potential difference measurement, suggests only the relationship between the electrode and the interlayer in an electrophotographic photoreceptor. From such a viewpoint, the present inventors measured the contact potential difference of the interlayer and the aluminum-evaporated surface in order to solve the aforementioned problems in the photoreceptor having such an interlayer. As a result, it was discovered that when the contact potential difference of the interlayer and the aluminum-evaporated surface is at least +0.175 V, the desired effects of the present invention were obtained, and the present invention was accomplished.

An interlayer comprised of common insulating resins functions only to minimize charge injection to a photosensitive layer from a base body, and to secure chargeability. As a result, sensitivity depends largely on ambient conditions. Further, even when an interlayer comprising titanium oxide is employed, variation of sensitivity due to ambient conditions is not improved unless the state is optimized. Further, when the interlayer having a thickness of at least 1 μm, particularly at least 5 μm is employed, residual potential increases greatly and the photoreceptor is not commercially viable. In the present invention, by controlling the contact potential difference of the base body and the interlayer, it becomes possible to carry out charge injection from the charge generating layer to the interlayer. As a result, even when the thickness of the interlayer is at least 1 μm, or to an extreme at least 5 μm, it is believed that a photoreceptor is realized which exhibits stable electric potential performance.

Titanium oxides, which have a variety of crystal forms, particle diameters, and surface-treated states, may be employed in the present invention. Anatase-type titanium oxides, having a particle diameter of 0.02 to 0.5 μm, exhibit particularly good results. Of these, those, which were subjected to no surface treatment and to an organic silane surface treatment, exhibited relatively good properties.

Employed as resins used in the interlayer may be various resins which are capable of dispersing titanium oxide. However, with respect to solubility during coating of an upper layer, as well as to adhesion, polyamide resins are preferred.

The specially described novelty of the present inventions is not involved in the employed materials themselves, but is involved in the dispersed state of said materials. The effects of the present invention were discovered by forming the state of the interlayer, which exhibits an electric potential difference of +0.175 with respect to the aluminum-evaporated surface through measurement of a contact potential difference.

Further, added as another means to confirm the state of optimized dispersion, the measurement of the transmittance of the interlayer may be considered.

Employed as a dispersion means may be homogenizers such as an ultrasonic homogenizer, a ball mill, a sand mill, a homomixer, and the like. Further, the interlayer is applied employing any of an applicator, a bar coater, a dip coater, a ring coater and the like, and subsequently drying the resulting coating.

The ratio of titanium oxide to binders is preferably between 0.1 and 100 weight parts per weight part of the binders, and is more preferably between 1 and 20 weight parts. The effects of the interlayer of the present invention are minimally influenced by variation of the layer thickness. Therefore, the layer thickness may optionally be determined so as to meet other required properties (for example, interference fringes). The layer thickness is preferably between 0.5 and 15 μm.

The solid portion concentration (solid portion weight/solvent volume [g/cm$^3$]) during dispersion of an interlayer coating composition is preferably between 3/100 and 100/100, and is more preferably between 10/100 and 50/100.

In order to specifically describe excellent properties of the present invention, examples of materials, which may be employed to constitute an electrophotographic photoreceptor, as well as of layer compositions, are shown below. However, the nature of the present invention is not limited to these examples.

The interlayer of the present invention may be employed in electrophotographic photoreceptors having the layer composition described below. It is premised that said interlayer is provided between the electrically conductive base body and the photosensitive layer, wherein the photosensitive layer is provided over the interlayer, and containing at least one of a charge generating material and a charge transporting material. A layered-type photoreceptor may be constituted in which a charge generating layer is provided as a lower layer and a charge transport layer is provided as an upper layer. Further, a single-layered type photoreceptor may be constituted in such a manner that charge generating materials, charge transport materials and other additives are mixed with supporting binders and dispersed, and the resulting dispersion is then applied. A photoreceptor may be constituted in which the lower layer comprises charge transport materials and the upper layer comprises charge generating materials. In any layer composition, a protective layer may be provided on the photosensitive layer.

During formation of a photosensitive layer, the charge generating layer is effectively formed employing a method, in which a composition prepared by finely dispersing a charge generating material alone or together with binders and additives into a suitable dispersion medium, is applied, or a method in which a charge generating material is subjected to vacuum evaporation. When the former is employed, employed as a dispersion means may be homogenizers such as an ultrasonic homogenizer, a ball mill, a sand mill, a homomixer and the like. A charge transport layer may be formed by applying solution prepared by dissolving a charge transport material alone, or together with binders and additives, employing a dip coating, an applicator, a bar coater, a dip coater, a ring coater and the like and subsequently drying the resulting coating. An interlayer, a charge generating layer, a protective layer, and the like may be formed employing the same means.

Listed as useful polymers as binders employed for a photosensitive layer as well as a protective layer are, for example, polystyrene resins, acrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymer resins comprising at least two of the repetitive units thereof. Other than these insulating resins, listed are high molecular organic semiconductors such as polyvinyl-N-carbazole and the like.

Employed as dispersion media for charge generating materials as well as charge transport materials are, for example, hydrocarbons such as toluene, xylene, and the like; halogenated hydrocarbons such as methylene chloride, 1,2-dichloroethane, and the like; ketones such as methyl ethyl ketone, cyclohexanone, and the like; esters such as ethyl acetate, butyl acetate, and the like; alcohols and derivatives thereof such as methanol, ethanol, propanol, butanol, methylcellosolve, ethylcellosolve, and the like; ethers such as tetrahydrofuran, 1,4-dioxane, 1,3-dioxolane, and the like; amines such as pyridine, diethylamine, and the like; nitrogen containing compounds such as N,N-dimethylformamide and the like; fatty acids and phenols; sulfur and phosphorous compounds such as carbon disulfide, triethyl phosphate, and the like. These compounds may be employed individually or in combination of at least two types.

The ratio of a charge generating material to binders is preferably between 1 and 600 weight parts of the charge generating material with respect to 100 weight parts of the binders. The ratio of a charge transport material to binders is preferably between 10 and 500 weight parts of the charge transport material with respect to 100 weight parts of the binders. The thickness of the charge generating layer is preferably between 0.01 and 20 $\mu$m. The thickness of the charge transport layer is preferably between 1 and 100 $\mu$m, and is more preferably between 5 and 50 $\mu$m. Further, in the case of a single-layer type electrophotographic photoreceptor, the ratio of binders: additives charge generating material: charge transport material is preferably 100:1 to 200:1 to 200:1 to 200, and the thickness of the formed photosensitive layer is preferably between 5 and 50 nm.

Employed as electrically conductive base bodies (supports) are flat metal plates and drums. Other than these, employed may be electrically conductive compounds such as electrically conductive polymers, indium oxides, and the like, and those prepared by providing a thin layer comprised of metal such as aluminum, palladium, and the like, onto paper, plasmatic film, and the like, employing means such as coating, evaporation, lamination, and the like.

In the photosensitive layer of the present invention, employed as optimal charge transport materials may be compounds such as triphenylamine derivatives, triphenylamine-styryl derivatives, hydrazone derivatives, tetraphenylbenzidine derivatives, butadiene derivatives, and the like.

Further, antioxidants may be incorporated into the photoreceptor of the present invention. Listed as antioxidants are hindered phenols, hindered amines, paraphenylenediamines, organic phosphorous compounds, and the like.

Further, other than these, added if desired, may be UV absorbers to protect the photosensitive layer, and color sensitivity correcting dyes may also be incorporated into the photoreceptor of the present invention.

EXAMPLES

The present invention will be specifically described below with reference to examples. Incidentally, "parts" in the descriptions represents "weight parts", unless otherwise specified.

Preparation of Interlayer Coating Composition 1

One part of polyamide resin CM8000 (manufactured by Toray Co.), 3 parts of titanium oxide TAF620 (manufactured by Fuji Titan Co.), 7.1 parts of methanol, and 0.81 parts of butanol were placed in the same vessel and dispersed employing an ultrasonic homogenizer. During dispersion, the contact potential difference of the coated layer prepared by employing the resulting dispersion was measured, and dispersion was continued until said contact potential difference with respect to the aluminum evaporated surface reached a predetermined value. An interlayer was then formed employing the resulting dispersion.

Preparation of Interlayer Coating Compositions 2 through 9

Coating compositions were prepared in the same manner as Interlayer Coating Composition 1, except that the weight ratio (P/B ratio) of the fine titanium oxide particles to the polyamide resin, employed in Interlayer Coating Composition 1, was varied as shown in Table 1.

Preparation Comparative Interlayer Coating Compositions 1 through 9

Dispersion was carried out in the same manner (although time and the like were varied) as Interlayer Coating Composition 1, except that the weight ratio (P/B ratio) of the fine titanium oxide particles to the polyamide resin, employed in Interlayer Coating Composition 1, was varied as shown in Table 1, and coating compositions were prepared.

TABLE 1

| Example | Interlayer Coating Composition | Titanium Oxide | Average Particle Diameter (in nm) | P/B Ratio | Contact Potential Difference (in V) | Thickness of Interlayer (in μm) | Transmittance (up to 5 μm) | Time of dispersion (minutes) |
|---|---|---|---|---|---|---|---|---|
| 1 | 1 | TAF1500 Fuji Titan Kogyo | 20–30 | 2/1 | 0.385 | 0.5 | — | 30 |
| 2 | 2 | TAF510 Fuji Titan Kogyo | 40 | 2/1 | 0.4 | 0.5 | — | 30 |
| 3 | 3 | TAF620 Fuji Titan Kogyo | 100 | 2/1 | 0.437 | 0.5 | — | 30 |
| 4 | 4 | TAF510 hexyl-TMS treatment 10% Fuji Titan Kogyo | 40 | 2/1 | 0.4 | 0.5 | — | 30 |
| 5 | 5 | TA300 Fuji Titan Kogyo | 300 | 3/1 | 0.425 | 10 | 0.42 | 30 |
| 6 | 6 | TA300 Fuji Titan Kogyo | 300 | 3/1 | 0.425 | 6 | 0.4 | 30 |
| 7 | 7 | A100 Ishihara | 150 | 3/1 | 0.3 | 6 | 0.6 | 30 |
| 8 | 8 | TAF510 Fuji Titan Kogyo | 40 | 1/1 | 0.375 | 6 | — | 30 |
| 9 | 9 | TAF620 Fuji Titan Kogyo | 100 | 1/1 | 0.225 | 5 | — | 30 |
| **Comparative Example** | **Comparative Interlayer Composition** | | | | | | | |
| 1 | 1 | A100 Ishihara Sangyo | 150 | 3/1 | 0.05 | 5 | 12 | 5 |
| 2 | 2 | TA300 Fuji Titan Kogyo | 300 | 3/1 | 0.15 | 6 | 19 | 5 |
| 3 | 3 | TA300 Fuji Titan Kogyo | 300 | 3/1 | 0.038 | 6 | 21 | 5 |
| 4 | 4 | TA300 Fuji Titan Kogyo | 300 | 1/1 | 0.463 | 5 | 26 | 5 |
| 5 | 5 | TT051 Ishihara Sangyo | 20–30 | 2/1 | −0.0037 | 0.5 | — | 10 |
| 6 | 6 | TT051 stearic acid treatment Ishihara Sangyo | 20–30 | 2/1 | 0.13 | 0.5 | — | 10 |
| 7 | 7 | TT051 alumina treatment + aminosilane treatment Ishihara Sangyo | 20–30 | 2/1 | 0.002 | 0.5 | — | 10 |
| 8 | 8 | IT-OD Idemitsu Kosan | 20 | 2/1 | 0.125 | 0.5 | — | 10 |
| 9 | 9 | no addition of titanium oxide | 0/1 | 0 | 0.5 | — | — | |

Interlayer Coating Composition 1 was applied onto an aluminum-evaporated PET film employing a wire bar, and subsequently dried at 100° C. for one minute to provide an interlayer. Employing a wire bar, applied onto the resulting interlayer was a dispersion prepared by dispersing 2 parts of titanyl phthalocyanine having a maximum diffraction peak in the X-ray diffraction spectrum (having a Brag angle of 2θ±0.2 degree) of a CuK α-ray at 27.2 degrees (furthermore having diffraction peaks at 9.5 degrees and at 24.1 degrees), one part of butyral resin, 70 parts of t-butyl acetate, and 30 parts of 4-methoxy-4-methyl-2-pentanone employing a sand mill to form an approximately 0.3 μm thick charge generating layer. Subsequently, applied onto the resulting charge generating layer was a solution prepared by dissolving 0.65 part of a charge transport material (Compound A described below) and one part of polycarbonate resin "Upiron-Z200" (manufactured by Mitsubishi Gas Kagaku Co.) in 7.5 parts of dichloroethane, employing a doctor blade, to prepare Example 1 Photoreceptor. Table 1 shows the thickness of interlayers as well as contact potential differences with the aluminum-evaporated surface.

Compound A

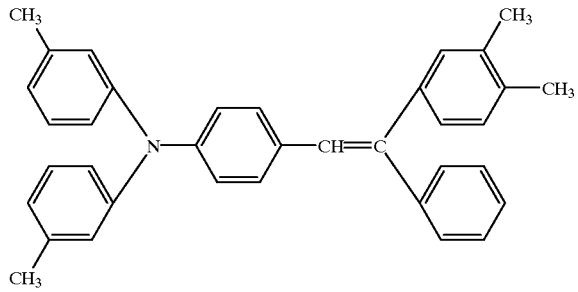

Examples 2 through 9

Photoreceptors were prepared in the same manner as Example 1, except that the interlayer coating composition employed in Example 1 was replaced with coating compositions shown in Table 1 and further, the layer thickness was varied as shown in Table 1.

Comparative Examples 1 through 9

Comparative Examples 1 through 9 were prepared in the same manner as Example 1, regarding preparation of the interlayer coating composition as well as photosensitive layer coating compositions, except that the titanium oxide employed in Example 1 was replaced with each of those shown in Table 1.

At the time, contact potential differences with the aluminum-evaporated surface are also shown in Table 1.

Evaluation 1

Experiments described below were carried out to confirm the variation of the sensitivity of photoreceptors at each of three ambient conditions, specifically normal temperature and normal humidity (19° C. and 30% RH), high temperature and high humidity (30° C. and 83% RH), and low temperature and low humidity (7° C. and 21% RH).

The photoreceptor of each of said Examples 1 through 9 and Comparative Examples 1 through 9, which was electrically grounded and adhered onto an aluminum drum, was subjected to 6,000 repetitions of charging, exposure and charge elimination, employing a modified digital copier Konica 7150, manufactured by Konica Corp., which machine has the reversal development system and is able to form an image from the first rotation of the photoreceptor, and the electric potential of the exposed area was measured at the start and just before the completion of said 6,000 repetitions.

Differences between the minimum value and the maximum value of the electric potential at the exposed area measured under each of the ambient conditions is shown in Table 2 as the VL ambient difference. A large value of said VL ambient difference indicates that variation of sensitivity due to ambient conditions, including repetition, is large.

Further, after completing said number of repetitions at ambient conditions of low temperature and low humidity, the photoreceptor was not employed for 10 minutes. Thereafter, the electrostatic potential on the photoreceptor was measured after the first rotation and the second rotation of said photoreceptor. The electrostatic potential difference between the first rotation and the second rotation was expressed as αV1-2. The obtained results are shown in Table 2. When said αV1-2 is large, during image formation, image density differs between the first rotation and the second rotation of the photoreceptor, and phenomena such as background staining, and the like, result.

Results 1

The results are shown in Table 2 below.

Photoreceptors of examples exhibited marked improvement of properties in the aspects described below, compared to photoreceptors of the comparative examples.

1) VL ambient differences are small and result in no large variation compared to comparative examples.

2) ΔV1-2 is small.

3) An increase in the thickness of the interlayer results in almost no variation of properties of the photoreceptor.

TABLE 2

| Example | Interlayer Coating Composition | Contact Potential Difference (in V) | Interlayer Thickness in μm | VL Ambient Difference | ΔV1-2 |
|---|---|---|---|---|---|
| 1 | 1 | 0.385 | 0.5 | 21 | 13 |
| 2 | 2 | 0.4 | 0.5 | 13 | 5 |
| 3 | 3 | 0.437 | 0.5 | 11 | 20 |
| 4 | 4 | 0.4 | 0.5 | 15 | −6 |
| 5 | 5 | 0.425 | 10 | 16 | 6 |
| 6 | 6 | 0.425 | 6 | 12 | 5 |
| 7 | 7 | 0.3 | 6 | 22 | 19 |
| 8 | 8 | 0.375 | 6 | 24 | 26 |
| 9 | 9 | 0.225 | 5 | 29 | 25 |
| **Comparative Example** | **Comparative Interlayer Coating Composition** | | | | |
| 1 | 1 | 0.05 | 5 | 268 | 68 |
| 2 | 2 | 0.15 | 6 | 207 | 59 |
| 3 | 3 | 0.038 | 6 | 343 | 71 |
| 4 | 4 | 0.163 | 5 | 378 | 48 |
| 5 | 5 | −0.0037 | 0.5 | 37 | 57 |
| 6 | 6 | 0.13 | 0.5 | 31 | 74 |
| 7 | 7 | 0.002 | 0.5 | 49 | 37 |
| 8 | 8 | 0.125 | 0.5 | 37 | 50 |
| 9 | 9 | 0 | 0.5 | 75 | 53 |

Example 10

Interlayer Coating Composition 6 was dip-coated onto a cylindrical aluminum base body and subsequently dried at 100° C. for 10 minutes to provide a 6.5 μm thick interlayer. Dip-coated onto the resulting interlayer was a coating composition prepared by dispersing two parts of titanyl phthalocyanine, having a maximum diffraction peak in the X-ray diffraction spectrum (having a Brag angle of 2θ±0.2 degree) of a CuK α-ray at 27.2 degrees (and hanging other peeks at 9.5 and 24.1 degrees), one part of butyral resin, 70 parts of t-butyl acetate, and 30 parts of 4-methoxy-4-methyl-2-pentanone, employing a sand mill, and a charge generating layer was formed so that the absorbance at a wavelength of 780 nm was about 2. Subsequently, dip-coated onto the resulting charge generating layer was a solution prepared by dissolving 0.65 part of a charge transport material (Compound A described above) and one part of polycarbonate resin "Upiron-Z200" (manufactured by Mitsubishi Gas Kagaku Co.) in 7.5 parts of dichloroethane to form an approximately 24 μm thick charge transport layer. Thus of Photoreceptor Example 10 was prepared. Further, the contact potential difference of the resulting interlayer was 0.425.

Comparative Example 10

Comparative Example 10 was prepared in the same manner as Example 10, except that the interlayer coating composition was replaced with one comprised only of CM8000 alone, without titanium oxide.

Evaluation 2

Experiments described below were carried out to confirm the variation of image properties at each of three ambient conditions of normal temperature and normal humidity (19° C. and 30% RH), high temperature and high humidity (30° C. and 83% RH), and low temperature and low humidity (7° C. and 21% RH). Each of the photoreceptors prepared in Example 10 and Comparative Example 10 was mounted on a modified Konica 7050, and was subjected to continuous image formation at each of said ambient condition. The image properties, at the initial and after producing 6,000 copies, were evaluated.

Results 2

In copies produced employing the photoreceptor of Comparative Example 10, the density of the halftone area increased at high temperature and high humidity; the density of the high density area decreased at low temperature and low humidity, and periodic image problems, due to interference fringes, occurred in the halftone images.

On the other hand, in copies produced employing the photoreceptor of Example 10, the aforementioned image problems were not observed.

Furthermore the photoreceptor of Example 10 produced excellent images from the first rotation of the photoreceptor under various conditions. On the other hand, the photoreceptor of Comparative Example 10 produced the image which contains a background staining in a white area of sheets at the first rotation threof.

According to the present invention, the effects described below are obtained.

Variation of sensitivity of the photoreceptor due to ambient conditions is minimized.

Difference in charge amount between the first and second rotation of an exhausted photoreceptor is minimized.

Degradation of chargeability due to ambient conditions, as well as repetition, is minimized.

Furthermore, variation of aforementioned properties is fairly independent of the thickness of the interlayer.

Consequently, it is possible to provide a photoreceptor capable of producing images without variation, and an electrophotographic process, as well as an electrophotographic image forming method, employing the same.

What is claimed is:

1. An electrophotographic photoreceptor comprising an interlayer comprised of fine titanium oxide particles and a resin between an electrically conductive base body having an aluminum-evaporated surface and a photosensitive layer wherein a contact potential difference of said interlayer with respect to the aluminum-evaporated surface is not less than +0.175 V.

2. The electrophotographic photoreceptor of claim 1 wherein the contact potential difference is not less than +0.200 V.

3. The electrophotographic photoreceptor of claim 2 wherein the contact potential difference is not less than +0.225 V.

4. The electrophotographic photoreceptor of claim 2 wherein a charge generating material is phthalocyanine.

5. The electrophotographic photoreceptor of claim 1 wherein thickness of said interlayer is at least 5 $\mu$m.

6. The electrophotographic photoreceptor of claim 1 wherein a charge generating material contained in the photosensitive layer is titanyl phthalocyanine having a maximum diffraction peak in the X-ray diffraction spectrum (having a Brag angle $2\theta \pm 0.2$ degree) of a CuK $\alpha$-ray at 27.2 degrees.

7. The electrophotographic photoreceptor of claim 1 wherein a charge generating material contained in the photosensitive layer is titanyl phthalocyanine having a maximum diffraction peak in the X-ray diffraction spectrum (having a Brag angle $2\theta \pm 0.2$ degree) of a CuK $\alpha$-ray at 27.2 degrees and peaks at 9.5 degrees as well as 24.1 degrees.

* * * * *